US008985190B2

(12) United States Patent
Jarry et al.

(10) Patent No.: US 8,985,190 B2
(45) Date of Patent: Mar. 24, 2015

(54) MULTI-ALLOY VERTICAL SEMI-CONTINUOUS CASTING METHOD

(75) Inventors: Philippe Jarry, Grenoble (FR); Serge Guy, Voiron (FR)

(73) Assignee: Constellium France, Paris (FR)

( * ) Notice: Subject to any disclaimer, the term of this patent is extended or adjusted under 35 U.S.C. 154(b) by 0 days.

(21) Appl. No.: 14/131,421

(22) PCT Filed: Jul. 10, 2012

(86) PCT No.: PCT/FR2012/000280

§ 371 (c)(1), (2), (4) Date: Jan. 7, 2014

(87) PCT Pub. No.: WO2013/007891

PCT Pub. Date: Jan. 17, 2013

(65) Prior Publication Data

US 2014/0138041 A1 May 22, 2014

(30) Foreign Application Priority Data

Jul. 12, 2011 (FR) ..... 11 02197

(51) Int. Cl.

*B22D 11/04* (2006.01)
*B22D 11/14* (2006.01)
*B22D 11/00* (2006.01)

(52) U.S. Cl.

CPC ..... *B22D 11/141* (2013.01); *B22D 11/007* (2013.01); *B22D 11/00* (2013.01)
USPC ..... 164/478; 164/416

(58) Field of Classification Search

CPC ..... B22D 7/00; B22D 7/02; B22D 7/064; B22D 11/00; B22D 11/007; B22D 11/008; B22D 11/051; B22D 11/053
USPC ..... 164/419, 478, 459, 460, 461, 486, 223, 164/441, 444, 348, 445, 487
See application file for complete search history.

(56) References Cited

U.S. PATENT DOCUMENTS

| | | | |
|---|---|---|---|
| 3,206,808 | A | 9/1965 | Robinson |
| 4,567,936 | A | 2/1986 | Binczewski |
| 7,472,740 | B2 | 1/2009 | Anderson et al. |

(Continued)

FOREIGN PATENT DOCUMENTS

| | | |
|---|---|---|
| DE | 4420697 | 12/1995 |
| EP | 1638715 | 12/2007 |

(Continued)

OTHER PUBLICATIONS

International Search Report for PCT/FR2012/000280 Mailed Dec. 13, 2012.

(Continued)

*Primary Examiner* — Kevin P Kerns
*Assistant Examiner* — Steven Ha
(74) *Attorney, Agent, or Firm* — Miles and Stockbridge

(57) ABSTRACT

The invention relates to a method for the vertical semi-continuous direct chill casting of composite billets or plates comprising at least two layers of aluminum alloys, using a separator which is in contact with the solidification front and which provides a seal between the two alloys during casting, said separator being vibrated while it is in contact with the solidification front, so that the separator is not frozen in and entrained by the solid metal. The invention also relates to a device that can be used to carry out said method.

28 Claims, 5 Drawing Sheets

(56) References Cited

U.S. PATENT DOCUMENTS

| | | | |
|---|---|---|---|
| 7,819,170 | B2 | 10/2010 | Anderson et al. |
| 8,312,915 | B2 | 11/2012 | Anderson et al. |
| 8,415,025 | B2 | 4/2013 | Anderson et al. |
| 2004/0137257 | A1 | 7/2004 | Kilmer et al. |
| 2005/0011630 | A1 | 1/2005 | Anderson et al. |
| 2009/0145569 | A1 | 6/2009 | Anderson et al. |
| 2010/0025003 | A1 | 2/2010 | Wagstaff et al. |
| 2011/0005704 | A1 | 1/2011 | Anderson et al. |
| 2011/0008642 | A1 | 1/2011 | Anderson et al. |
| 2013/0034744 | A1 | 2/2013 | Anderson et al. |

FOREIGN PATENT DOCUMENTS

| | | |
|---|---|---|
| EP | 1872833 | 1/2008 |
| WO | 03035305 | 5/2003 |
| WO | 2008104052 | 9/2008 |
| WO | 2009024601 | 2/2009 |

OTHER PUBLICATIONS

Pinkham, "Novelis Fusion—A Solution to Cladding," Aluminium International Today, vol. 18, No. 4, pp. 32,34, (Jul. 1, 2006).

French Search Report and Written Opinion for FR1102197 Dated Feb. 23, 2012.

MULTI-ALLOY VERTICAL SEMI-CONTINUOUS CASTING METHOD

CROSS REFERENCE TO RELATED APPLICATIONS

This application is a §371 National Stage Application of PCT/FR2012/000280, filed Jul. 10, 2012, which claims priority to French Application No. 1102197, filed Jul. 12, 2011.

BACKGROUND OF THE INVENTION

1. Field of the Invention

The invention relates to the manufacture of semi-finished products such as rolling slabs and extrusion billets using a semi-continuous aluminium alloy vertical direct chill casting process.

Specifically, the invention concerns a semi-continuous vertical casting process in which slabs or billets consisting of two or more aluminium alloys are cast simultaneously, with the aid of one or more separators.

The invention also relates to the equipment used to operate the aforementioned process and manufacture the aforementioned slabs or billets.

2. Description of Related Art

Use of aluminium in the aeronautics and automotive sectors is increasing. Applications include the manufacture of fuselage sheeting, wing spars and stringers, weight-saving body sheets and heat exchangers for the automotive industry, optical reflectors and armour plating, thermoplastic moulds, forgings and machinable parts.

In particular, such applications for aluminium, of which the above list is not exhaustive, require a compromise to be achieved between properties that are in many cases antagonistic, such as mechanical strength and workability, mechanical strength and corrosion resistance or suitability for drilling or turning.

All aluminium alloys mentioned herein are identified, unless otherwise stated, according to the designations defined in the "Registration Record Series" published regularly by the "Aluminum Association".

Although uniform alloys may be used to fulfil certain requirements, substantial improvements are potentially achievable by, for example, controlling variations in composition between the surface and the core of a sheet, or between the surface and the core of an ingot used in an extrusion, forging or machining process, thereby differentiating between surface properties and core properties.

Cladded products, manufactured using two plates made of different alloys that are co-rolled in a hot process, exist for certain applications. Examples include:

Brazing sheets, intended primarily for heat exchangers (particularly in the automotive industry); the cladding material consists of an alloy with a lower melting point than the core, enabling it to serve as a filler material that joins the parts to be assembled during the brazing process.

Sheet for use in aircraft, in which a weakly-alloyed cladding material provides corrosion resistance for a more strongly-alloyed and mechanically stronger core. The same applies to body panels for the automotive sector, for which a weakly-alloyed cladding material is applied over a more strongly-alloyed, stronger core alloy for enhanced workability, in particular in stamping, bending and hemming operations.

The same principle also applies to a variety of other two-layer products, including optical reflectors that feature a low-cost alloy coated with a very pure aluminium alloy, and two-layer materials used in military armour.

However, this hot co-rolling process is not suitable for use with all types of alloy, particularly alloys containing significant quantities of zinc and/or magnesium (as used in the automotive, aeronautics and other industries) due to the susceptibility to surface oxidation of magnesium- and zinc-rich alloys. In addition, double hot-rolling is very often necessary, adversely impacting productivity and costs.

Accordingly, processes enabling the simultaneous casting of two alloy layers, known as bi-alloy casting, have been developed in a semi-continuous vertical casting format.

Patent application WO 03/035305 A1 and U.S. Pat. No. 7,407,713 B2 filed by Alcoa Inc., as well as other similar patents disclose the use of a separator consisting of a metal foil (unrolled from a roll) that becomes trapped in the solidification front and is entrained by the solid metal as the plate descends. This separator remains embedded in the finished slab.

A disadvantage of this solution is that it is technically challenging to implement, due in particular to the need to preheat a significant length of the metal foil, as well as issues relating to competition for space with the liquid metal supply systems, and above all, the fact that when two oxidized surfaces are introduced into the liquid metal a satisfactory metallurgical bond cannot be guaranteed, resulting in a non-negligible risk of subsequent delamination.

U.S. Pat. No. 4,567,936 filed by Kaiser Aluminum & Chemical Corporation claims a bi-alloy casting method in which the core is fully encapsulated in the coating alloy layer. This outer layer is solidified in advance and the core alloy is cast inside the casing thus formed. In this configuration, the outer alloy requires a significantly higher liquidus than the core alloy. In addition, the inner surface of the outer layer is necessarily oxidized, again making it hard to ensure a satisfactory metallurgical bond between the two layers. Furthermore, the principal claim of the aforementioned patent is to protect the Al—Li interior alloy against the effects of direct water cooling.

Patent applications US2005/0011630 A1 and US2010/0025003 A1, filed by Novelis Inc., are based on a similar idea, although the core is not fully embedded in the coating alloy. They describe a process that yields a sound interface because a temporarily-solidified layer of the inner alloy acts as the separator. This process, which is known within the industry by the name "Fusion™", is more suitable for alloy pairs in which the outer alloy has a lower liquidus than the inner alloy. In other alloy combinations, obtaining a satisfactory metallurgical bond requires very tight control of the thermal transients. In some cases, the desired result may be impossible to achieve.

Patent application DE 44 20 697 A1 filed by the "Institut fur Verformungskunde and Hüttenmaschinen" in Leoben is based on the principle of an exogenous separator placed in close proximity to the solidification front. However, this configuration requires the separator to be positioned and maintained at a slight distance from the front, to avoid it being trapped by solidification. As a result, significant convection currents form below the separator, causing relatively pronounced mixing of the two alloys, which are therefore not truly separated.

Patent application WO 2009/024601 A1 filed by Aleris Aluminium Koblenz GmbH also claims the use of a separator, which is inserted centrally into the slab, at mid-thickness. With this process too, a mixing area forms that is hard to reproducibly control in an industrial process; in addition, the process is limited by the fact that the two layers must be the same thickness by construction. Most industrial applications require layers with very different thicknesses, however.

SUMMARY

The invention described herein aims to overcome the aforementioned difficulties by enabling the introduction of a separator that enters into direct contact with the solidification front but does not become trapped and entrained by the solidifying metal; rather, it forms a seal between the two alloys, limiting any mixing via the semi-solid zone, even if there is a difference in the levels on each side of the separator.

SUBJECT OF THE INVENTION

The invention concerns a semi-continuous vertical direct chill casting process for manufacturing rolling slabs or extrusion billets, in which a separator and two liquid metal supply systems, typically spouts or channels arranged on either side of the separator, are used. This process features the following steps:

a) One aluminium alloy is cast through a spout into the semi-continuous vertical casting mould, b) The separator, made of metal or a refractory material, is introduced into the mould, in contact with the solidification front, c) The second aluminium alloy is cast into the semi-continuous vertical casting mould, on the other side of the separator, via a second spout, d) The separator is raised almost simultaneously with the end of casting of the alloys, or slightly before casting is complete, in which case, the alloys may mix together in the zone in which slab or billet casting ended, e) The solidified slab or billet is removed from the semi-continuous casting mould, characterized in that, by using a vibrator, a vibratory motion is applied to the separator, at least while it is in contact with the solidification front to prevent said separator from becoming trapped and entrained by the solidified metal.

Ideally, the separator is raised slightly before casting ceases, enabling the alloys to mix in the zone where casting ends. This end zone is then cropped.

This process is of particular benefit in cases where the alloys have different compositions, as it enables bi-alloy slabs and billets to be cast. The zone containing a single alloy produced at the start of the casting operation, before the separator is inserted and the second alloy is cast, should preferably also be cropped.

The separator may be a largely flat plate, the bottom of which is cut such that it mates with a vertical cross-section of the solidification front extending across the mould to enable slabs or billets to be produced with superimposed layers of different alloys.

It may also be a hollow cylindrical body, generally but not necessarily matching the product's geometrical symmetry, enabling composite billets to be cast; similarly, it may take the form of a hollow body of essentially rectangular cross-section enabling so-called "filled" slabs to be cast with different alloys inside and outside the separator.

In the latter case, the separator's basically rectangular cross-section may be either perfectly rectangular or feature rounded corners for more effective mating with a horizontal section of the cast slab's solidification front. If the separator is perfectly rectangular, its bottom features a flat surface with profiled corners that match the shape of the solidification front in the corners.

The aforementioned separator may be made of a metallic material such as steel, or a refractory metal such as molybdenum or tungsten.

Alternatively, it may be made of a ceramic or glass fibre-reinforced ceramic refractory material.

The amplitude of the vibrations applied to the separator is small, typically around 100 μm at frequencies ranging from approximately 100 Hz up to ultrasonic frequencies.

This vibratory motion is produced by any pneumatic, electric or ultrasound-emitting vibrator. A vibration frequency in a range between 100 and 20,000 Hz should preferably be adopted, and a vibration amplitude in a range between 10 and 1000 μm is beneficial, preferrably between 100 and 200 μm.

In a particular mode, the aforementioned first and second alloys have be same composition. The applicant has observed that the vibratory motion exerts a beneficial effect by decreasing macrosegregation.

By extension, the process may be used to cast more than two alloys, using multiple separators in such cases.

The invention also concerns the means of implementing the disclosed process, namely a directly-cooled, semi-continuous vertical slab or billet casting process featuring a tubular cylindrical or rectangular semi-continuous vertical casting mould that is open-ended except for the bottom end, which is sealed at the start of casting by a bottom block. A lowering mechanism moves this bottom block downwards as the slab or billet is cast. Liquid metal is poured into the top of the mould, and the slab or billet exits from the bottom end. The top opening is equipped with two metal supply devices, typically spouts or troughs, and a separator designed to be inserted into the sump of liquid metal in contact with the solidification front inside the mould, thereby dividing the sump into two separate zones, characterized by the fact that the separator is connected to a vibrator device that enables a typically multidirectional vibratory motion to be imparted to the separator, at least throughout the period in which it is in contact with the solidification front. These vibrations are of low amplitude, typically of the order of 100 μm (preferably between 100 and 200 μm), and are delivered at frequencies in a range from approximately 100 Hz up to ultrasonic frequencies, (preferably between 100 and 20,000 Hz).

As stated above, the separator may be an essentially flat sheet, a hollow cylinder used in combination with a cylindrical mould of essentially circular cross-section, or an essentially rectangular hollow body used in combination with a mould of essentially rectangular cross-section.

In the latter case, the separator's essentially rectangular cross-section may have rounded corners mating a horizontal section of the sump.

The aforementioned cross-section may also be perfectly rectangular, in which case the bottom of the separator is defined by a non-flat surface with profiled corners deriving from the intersection of a rectangular cylinder with the front.

The aforementioned separator may be made of a metallic material such as steel, or a refractory metal such as molybdenum or tungsten.

Alternatively, it may be made of a ceramic or glass fibre-reinforced ceramic refractory material.

The vibratory motion may produced by any pneumatic, electric or ultrasound-emitting vibrator.

By extension, the device may naturally feature more than one separator and more than two liquid metal supply devices, enabling slabs or billets to be cast using more than two aluminium alloys.

DETAILED DESCRIPTION OF A PREFERRED EMBODIMENT

Figure 1:
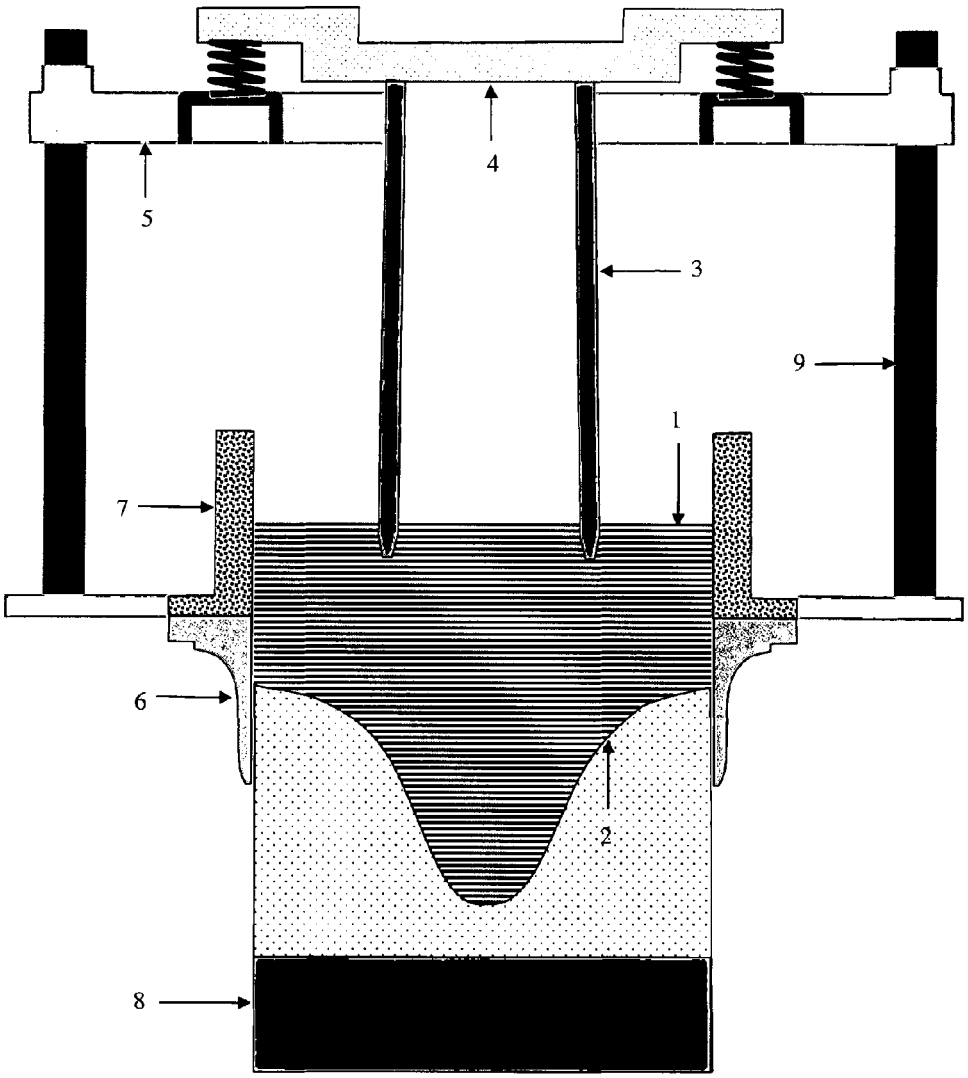
FIG. 1 is a cross-section showing the initial stage of casting the first alloy (1) into the mould (6), which is fitted with a hot top made of refractory material (7), onto the casting base or "bottom block" (8), as well as the solidification front (item 2), the separator (3)—in this case of rectangular or cylindrical design—secured to a plate (4) to which the vibrator (not shown) is also attached. The vibrator is connected by means of flexible springs to an assembly (5) that descends along guides (9).
Figure 2:
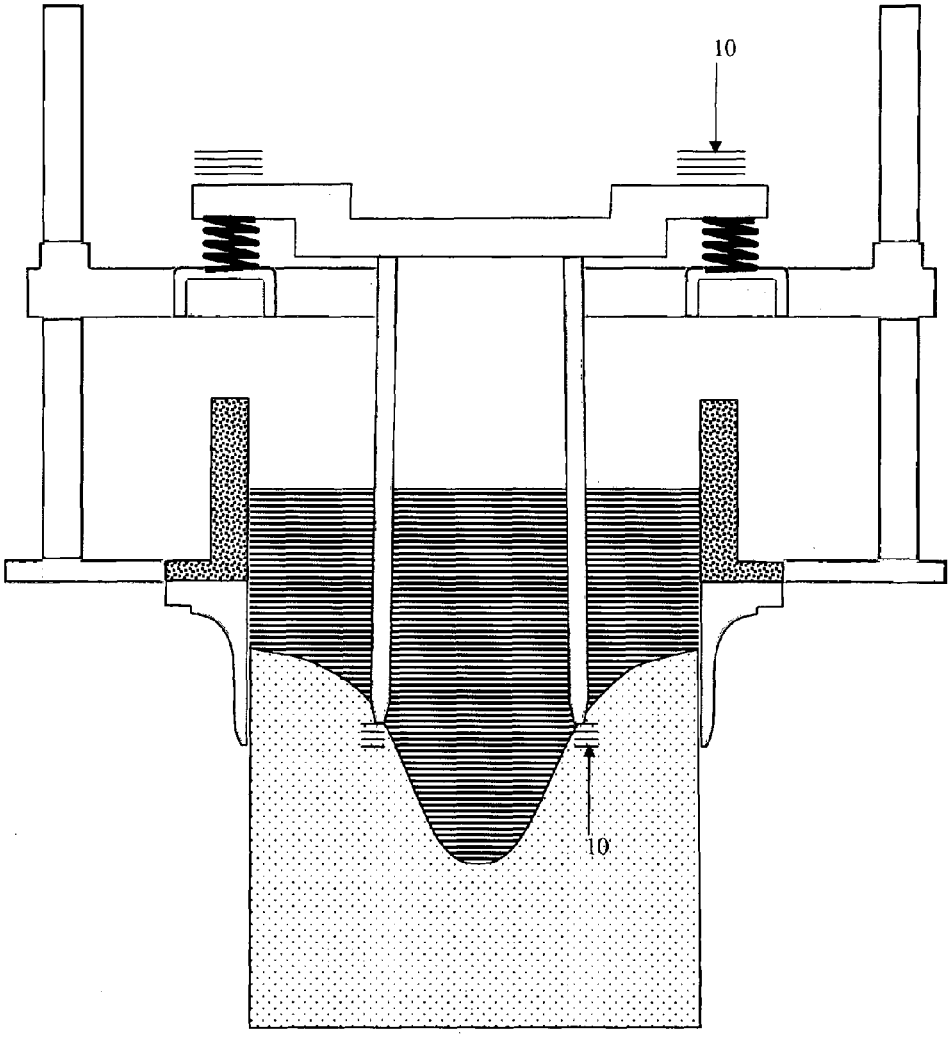
FIG. 2 shows the second stage of casting, during which the separator (3) is brought into contact with the solidification front and the vibration system (10) is engaged.
Figure 3:
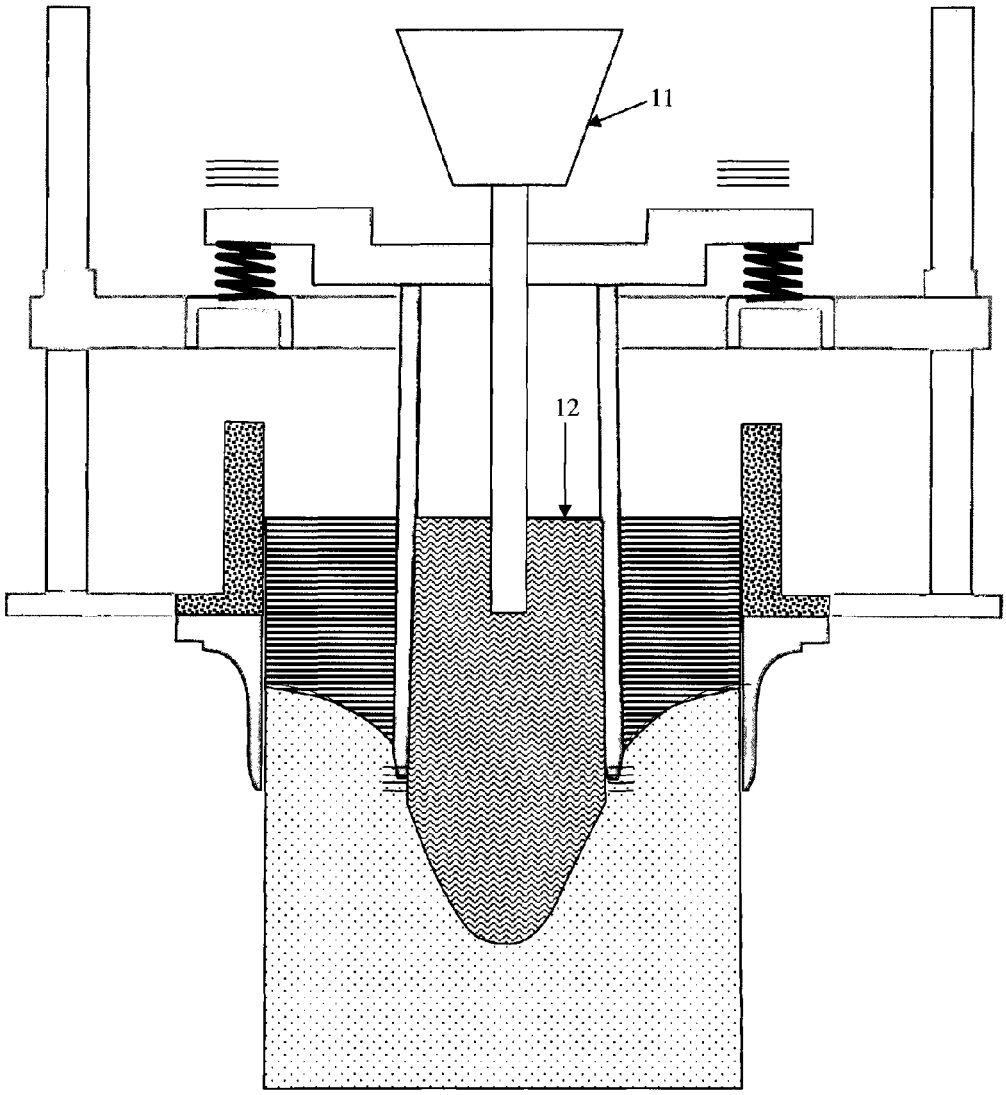
FIG. 3 shows the third stage of casting, during which the metal supply nozzle (11) for the second alloy (12) is moved into position and the second alloy is cast.
Figure 4:
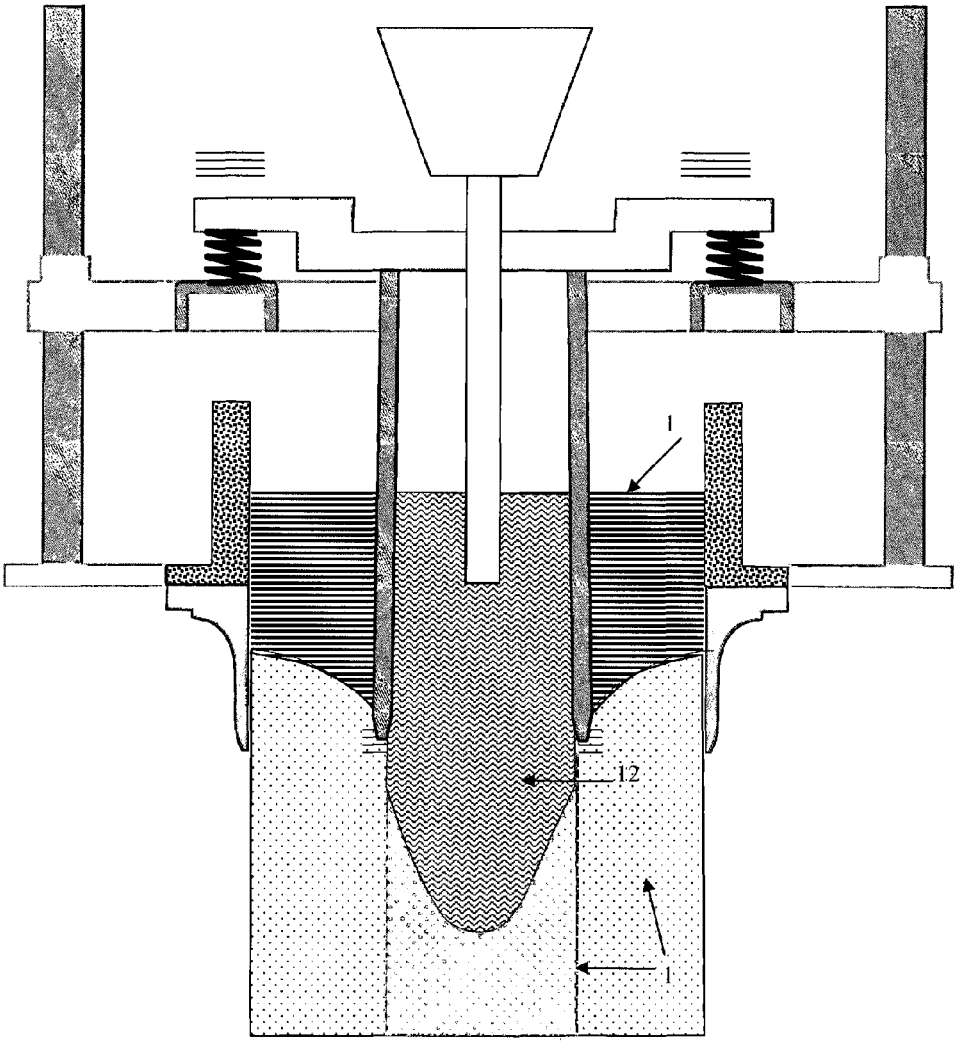
FIG. 4 shows the steady-state operating conditions, with the second alloy (12) forming the core of the slab or billet and the first alloy (1) forming the base to be cropped, mixed with the second alloy, and around the perimeter.

To prevent the separator from becoming entrained by the solidified metal, the invention subjects the separator to a low-amplitude (typically 100 to 200 μm) vibratory motion that breaks any dendrites forming in contact with the separator, locally deflects the dendritic coherence towards greater solidified fractions, thereby ensuring that the separator is not entrained by the solid metal. Several types of vibrator may be used, including pneumatic, electric and ultrasound-emitting devices, generating vibrations at frequencies typically in the range between 100 and 20,000 Hz.

The separator may be a hollow cylindrical body, preferably with a horizontal surface closing off its bottom end, having a profile that mates with a horizontal cross-section of the solidification front to form an effective seal. For rectangular slabs, the separator's cross-sectional profile is designed by 3D thermal modelling of the solidification front; it forms a rectangle with corners rounded according to a specific law. If the alloys are to be separated at a constant distance from the slab surfaces, including in the regions near its edges, a separator may be designed with a perfectly rectangular cross-section; in such cases, the bottom end is not defined by a flat surface, but by a non-flat surface with profiled corners corresponding with the intersection of a virtual rectangular cylinder of the desired section with the front surface. This surface may also be calculated by 3D thermal modelling of the front. For billets, the separator naturally has a circular cross-section. Several types of separator may be used, including separators made of non-metallic refractory materials or metallic materials (e.g. steel or refractory metals such as molybdenum or tungsten), where appropriate with a coating to protect against aggression by the liquid aluminium.

Where necessary, this configuration preserves the geometric and thermal symmetry of the bi-alloy slab or billet. This concept of a "filled" slab or billet, in which a core cast in one alloy is totally encapsulated inside a second alloy, also offers certain new possibilities not available with existing processes. For example, because the outer alloy is present on the sides of the slab (which is not the case with the Fusion™ process or co-rolling process), rolling techniques may be used to process core alloys that contain large proportions of magnesium (more than 5% or even 7%), zinc (up to 15% or more), copper (up to 5% or more), lithium (up to 2% or more), silicon (including hypereutectic silicon contents) or combinations of such elements, while avoiding cracking from the edges, which is a phenomenon currently observed when attempting to hot roll such multi-layer products.

Such compositions offer a good compromise of mechanical strength and workability, and encapsulating the core alloy can result in superior corrosion resistance and/or workability. This opens up new scope in terms of applications for aluminium, notably manufacturing parts with very complex shapes for the automotive, aeronautics, transportation and mechanical engineering industries.

This is in particular the case when a core alloy in the AA7xxx family having a very high content of hardening alloy elements (especially AA7021, or AA5xxx which also has a very high content) is combined with an outer or cladding alloy in the AA6xxx family (in particular AA6016) for car body panel applications.

This is also the case when a core alloy in the AA7xxx family having a very high content of hardening alloy elements (especially AA7449) is combined with an outer or cladding alloy in the AA5xxx family (in particular AA5083) for armour plating applications.

Manufacturing filled billets may offer the added benefit of enabling very rapid extrusion of hard alloys protected by a casing of softer alloy, enabling the hard alloy to be solutionized due to the temperature reached during the extrusion operation: a temperature which normally cannot be attained due to the limitation in extrusion speed of such hard alloys because of their poor extrusion abilities. The fact that the hard alloy is surrounded by a layer of "soft" alloy makes the composite material easier to extrude, and at higher speed, enabling the hard alloy to be heat treated simply by the extrusion heating process. This specificity is of particular benefit in reverse extrusion applications.

For such applications, the separator may consist of a vertical flat sheet cut such that it mates with a vertical cross-section of the solidification front parallel to one of the slab's faces, or to a generatrix in the case of billets. In such cases, the result is not a filled slab or billet, but a two-layered product or even a product with three (or more) layers if two (or more) flat separators are used.

In all cases, the separator may not respect the geometric and thermal symmetry of the slab or billet, in order to obtain different layer thicknesses on the various sides. In practice, filled slab or billet casting begins with just the casing alloy. The separator is then introduced into the liquid metal, caused to vibrate, and lowered until it comes into contact with the solidification front; the core alloy injection trough is lowered ready to supply core alloy to the space inside the separator. The vibratory motion prevents the separator from becoming trapped by the front. Experience has shown that it is possible to obtain differences in level between the two sides of the separator, in either direction, proving that it forms an effective seal. The separator is raised at the end of the casting process, allowing the two alloys to mix. The affected area must be cropped, unless a change in composition along the length of the cast slab or billet is deliberately intended, with the alloys being chosen accordingly. This aspect represents an additional degree of freedom offered by the vibrating-separator casting process.

Where the separator consists of a "simple" flat plate, for casting two-layer products (or three-layer products if two such flat separators are used), casting is started using a single alloy. The separator plate is then introduced into the liquid metal, caused to vibrate, and lowered until it comes into contact with the solidification front; the injection channel for the other alloy is lowered ready to supply the second alloy to the other side of the separator. The remainder of the casting process is performed as before.

Naturally, with any configuration, including filled slabs or billets and simple two-layer products, as well as applications combining an alloy delivering high mechanical strength with another alloy having good workability properties for automotive body panels or two-layer armour plating products, this process may also be used to cast a wide variety of other products, including two-layer parts having a core of any type of alloy and a very pure aluminium alloy plating layer for "high gloss" applications, products having a core alloy clad with a coating alloy for brazing sheet applications, two-layer products for wing spars and stringers, etc.

The invention may also be adapted for manufacturing ingots, slabs or billets having more than two aluminium alloy layers, by using multiple separators.

The details of the invention will be more easily understood with the help of the examples below, which are not, however, restrictive in their scope.

EXAMPLES

Example 1

This initial test is not consistent with the invention as the plate-type separator does not extend across the mould and only one cast of a single alloy was performed; the purpose of this test was to demonstrate the effectiveness of vibration as a means of preventing the plate from becoming entrained by the solidified metal.

A one-piece plate made of a glass-fibre and refractory composite material was introduced into and caused to vibrate in the casting pool for an AA1050 alloy rolling slab with cross-sectional dimensions of 1100×300 mm.

The refractory plate was 200 mm wide. It was inserted parallel to the large rolling surface, 65 mm from the mould wall.

The refractory composite plate was vibrated by means of a "Netter NTC" pneumatic vibrator, as used for emptying grain silos and hoppers. This vibrator unit generates low-amplitude, multi-directional vibrations.

The vibrating plate was brought into contact and held against the solidification front.

A rod was used as a probe to ensure that there was effective contact. Various pneumatic vibrator operating pressures (between 2 bars and 4 bars) were tested, such that, allowing for the device's intrinsic vibration frequencies, a vibratory amplitude of approximately 100 to 200 μm was obtained at a frequency of around 100 Hz.

At the end of the casting operation, after casting 400 mm with the plate at the solidification front (set to 4 bars), the compressed air supply was shut off, interrupting the vibratory motion.

The plate immediately became trapped by the solidification front.

Example 2

The following materials were cast during this test:

a bi-alloy slab with an outer casing in AA5083 alloy and a core in AA7449 alloy, a typical composition for armour plating applications.

a bi-alloy slab with an outer casing in AA6016 alloy and a core in AA7021 alloy, a typical composition for automotive body panel applications.

The dimensions of the total cross-section of the slabs were 1100×300 mm.

For these tests, a one-piece separator made of glass fibre/refractory composite material was produced with an essentially rectangular cross-section designed to mate with the solidification front along a horizontal plan. Using this separator, a 75 mm thick outer layer of alloy was cast around the perimeter of the slab.

In the radiused parts near the corners, dictated by the shape of the solidification front in those zones, the core was homothetic with the total cross-section, having typical dimensions of 950×150 mm.

The separator was 12 mm thick along its full height except for its bottom end, which tapered to a thickness of 4 mm over a distance of 15 mm.

In practice, when casting had been started with the casing alloy, the separator was inserted into the pool and lowered to touch the solidification front while being subjected to vibrations in the same conditions as in example 1, to prevent it from being entrained by the solidified metal.

The vibrations were generated using the same pneumatic vibrator, screwed to the metal frame supporting the separator. This supporting frame was able to slide along vertical guide rods, and was motorized using a worm gear drive.

The core alloy supply channel was then lowered and the internal cavity formed by the separator filled.

An effective seal was formed, ensuring that the alloys remained separate; this was demonstrated by the differences in level between the compartments inside and outside the separator that were observed during casting as a result of minor fluctuations in the respective flow rates of the alloys. Slices of the slab were observed, revealing that the granular structure was locally finer in the immediate vicinity of the separator, probably due to mechanical action of the vibrations on the dendrites.

Spark emission spectrometry was used to determine the zinc content of a cross-section of the two types of slab, depending on the distance in mm (d) from an external surface of the slab, measured across its thickness.

Figure 5:
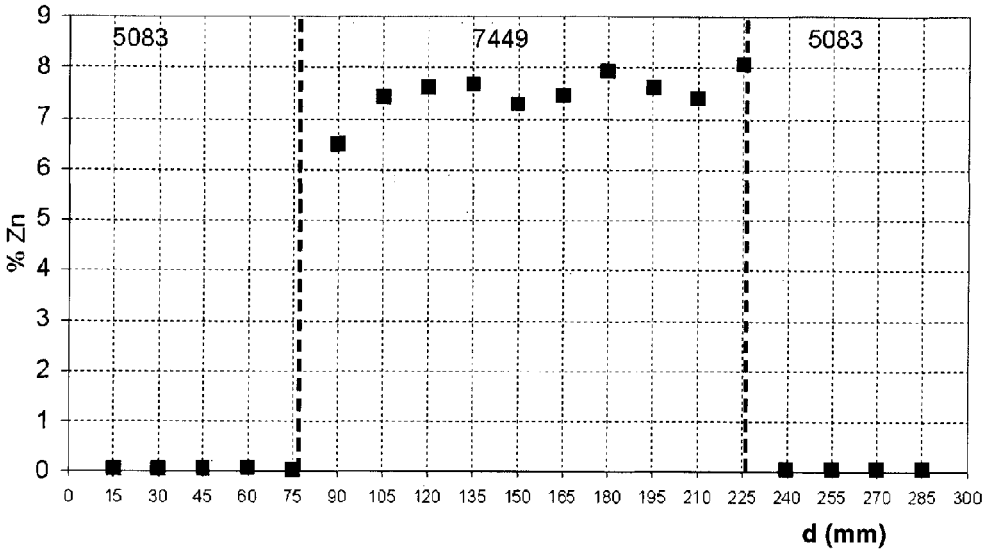
FIG. 5 shows the percentage of zinc of a cross-section of the bi-alloy slab in example 2, having an outer part cast with the alloy AA5083 and a core cast in AA7449, based on the distance d (in mm) from an outer face of the slab (measured in the direction of its thickness), determined using spark emission spectrometry.
Figure 6:
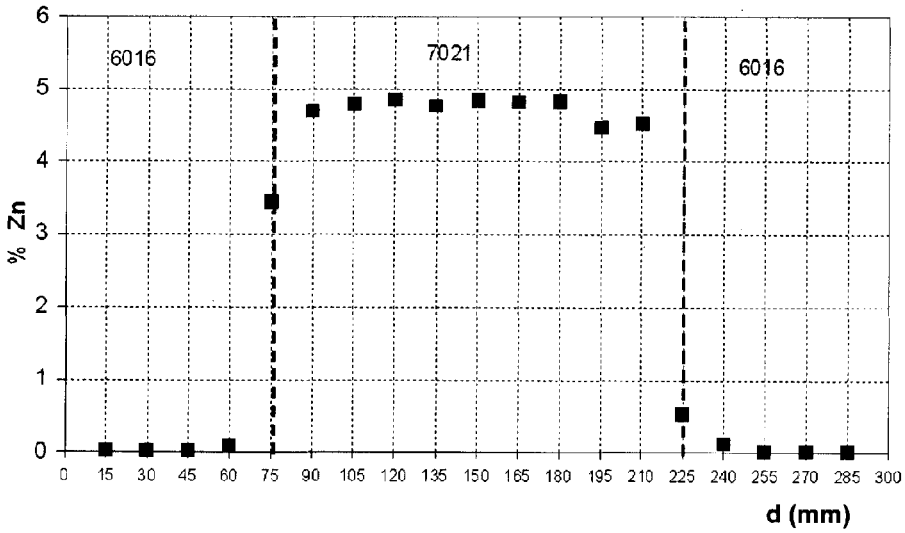
FIG. 6 shows the percentage of zinc of a cross-section of the bi-alloy slab in example 2, having an outer part cast with the alloy AA6016 and a core cast in AA7021, based on the distance d (in mm) from an outer face of the slab (measured in the direction of its thickness), determined using spark emission spectrometry.

These composition profiles are shown in FIGS. 5 and 6, confirming that the alloys were effectively separated.

The invention claimed is:

1. A semi-continuous vertical direct chill casting process for manufacturing a rolling slab and/or extrusion billet, in which a separator and two liquid metal supply systems, optionally spouts or troughs or tundishes, arranged on either side of the separator, are used, and wherein said process comprises:

a) One aluminium alloy is cast through a first liquid metal supply system, optionally a spout or trough or tundish, into a semi-continuous vertical casting mould, b) The separator, made of metal and/or a refractory material, is introduced into the mould, in contact with the solidification front, c) A second aluminium alloy is cast into the semi-continuous vertical casting mould, on the other side of the separator, via a second liquid metal supply system, optionally a spout or trough or tundish, d) The separator is raised simultaneously with the end of casting of the alloys, or before the end of casting of the alloys, in which case, the alloys may mix together in a zone in which slab and/or billet casting ended, e) The solidified slab and/or billet is removed from the semi-continuous casting mould, wherein a vibrator, and/or a vibratory motion is applied to the separator, at least while said separator is in contact with the solidification front, to prevent said separator from becoming trapped and/or entrained by solidified metal.

2. A process according to claim 1, wherein the separator is raised before casting ceases, enabling the alloys to mix in a zone where casting ends, with said end zone then being cropped.

3. A process according to claim 1, wherein the alloys have different compositions.

4. A process according to claim 1, wherein a part of the slab and/or billet where casting begins, before the separator is inserted and the second alloy cast, is also cropped.

5. A process according to claim 1, wherein the separator is a flat plate cut so as to mate with a vertical section of the solidification front extending across the mould.

6. A process according to claim 1, wherein the separator is a hollow cylinder.

7. A process according to claim 1, wherein the separator is a hollow body of essentially rectangular cross-section.

8. A process according to claim 7, wherein the essentially rectangular cross-section comprises at least one rounded corner for mating with a horizontal cross-section of the solidification front of a cast slab.

9. A process according to claim 7, wherein said process involves a hollow body that has a rectangular cross-section and a bottom defined by a non-flat surface with at least one profiled corner that matches a shape of the solidification front in a corner.

10. A process according to claim 1, wherein the separator comprises steel and/or a refractory metal optionally comprising molybdenum or tungsten.

11. A process according to claim 1, wherein the separator comprises ceramic and/or glass fibre-reinforced ceramic refractory material.

12. A process according to claim 1, wherein amplitude of vibrations applied to the separator is around 100 μm at a frequency ranging from approximately 100 Hz up to an ultrasonic frequency.

13. A process according to claim 1, wherein vibratory motion is produced by any pneumatic, electric and/or ultrasound-emitting vibrator.

14. A process according to claim 1, wherein vibration frequency is in a range from 100 to 20,000 Hz.

15. A process according to claim 1, wherein vibration amplitude is in a range from 100 to 200 μm.

16. A process according to claim 1, wherein the first and second alloys have the same composition.

17. A process according to claim 1, modified to enable casting of more than two alloys, using multiple separators.

18. A semi-continuous direct chill vertical slab and/or billet casting device comprising a tubular cylindrical and/or rectangular semi-continuous vertical casting mould that is open-ended except for a bottom end, which is sealed at a start of casting by a bottom block, and wherein a lowering mechanism moves said bottom block downwards as the slab and/or billet is cast and solidified by water in direct contact with a product, and wherein liquid metal is poured into a top of the mould, and the slab and/or billet exits from a bottom end, and wherein a top opening is equipped with two metal supply devices, optionally spouts or troughs or tundishes, and a separator designed to be inserted into a sump of liquid metal in contact with a solidification front inside the mould, thereby dividing the sump into two separate zones, and further wherein the separator is connected to a vibrator device that enables a multidirectional vibratory motion to be imparted to the separator, at least throughout a period in which said separator is in contact with the solidification front, and wherein said vibrations have an amplitude from 100 to 200 μm, and are delivered at a frequency in a range from approximately 100 Hz up to ultrasonic frequency.

19. A device according to claim 18, wherein the separator is a flat plate.

20. A device according to claim 18, wherein the separator is a hollow cylinder used in combination with a tubular mould of essentially circular cross-section.

21. A device according to claim 19, wherein the separator is a hollow body of essentially rectangular cross-section used in combination with a tubular mould of essentially rectangular cross-section.

22. A device according to claim 21, wherein the essentially rectangular cross-section of the separator features one or more rounded corners mating with a horizontal section solidification front of a cast slab.

23. A device according to claim 21, wherein the separator is of rectangular cross-section and has a bottom defined by a non-flat surface with one or more profiled corners that match a shape of the solidification front.

24. A device according to claim 18, wherein the separator comprises steel and/or a refractory metal optionally molybdenum or tungsten.

25. A device according to claim 18, wherein the separator comprises a ceramic and/or glass fibre-reinforced ceramic refractory material.

26. A device according to claim 18, wherein the vibratory motion is produced by any pneumatic, electric and/or ultrasound-emitting vibrator.

27. A device according to claim 18, capable of being modified to comprise more than one separator and more than two liquid metal supply devices, enabling slabs and/or billets to be cast using more than two aluminium alloys.

28. A device according to claim 18, wherein said vibrations are delivered at a frequency of from 100 to 20,000 Hz.

* * * * *